US005316497A

United States Patent [19]

Topolewski et al.

[11] Patent Number: 5,316,497

[45] Date of Patent: May 31, 1994

[54] ELECTRICAL CONNECTOR

[75] Inventors: John N. Topolewski, Westland; Jeffrey A. Burnside, Dearborn Heights, both of Mich.

[73] Assignee: United Technologies Automotive, Inc., Dearborn, Mich.

[21] Appl. No.: 82,085

[22] Filed: Jun. 24, 1993

[51] Int. Cl.[5] ..... H01R 13/62

[52] U.S. Cl. ..... 439/752; 439/346

[58] Field of Search ..... 439/752, 595, 689, 691, 439/686, 346, 259

[56] References Cited

U.S. PATENT DOCUMENTS 3,602,875 8/1971 Pierini ..... 439/752

4,847,733 7/1989 Roy et al. ..... 248/223.1

*Primary Examiner*—Gary F. Paumen

*Attorney, Agent, or Firm*—Harness, Dickey & Pierce

[57] ABSTRACT

An electrical connector adapted to even more securely and positively hold a conventional terminal element therein such that the terminal element cannot be withdrawn from a main body portion of the connector by a pulling or tugging force. The connector comprises a main body portion having an inner upper wall portion and an inner lower wall portion. A plurality of upper bores are formed in connection with the inner upper wall portion, and a plurality of lower bores are formed in connection with the inner lower wall portion. Each of the inner upper and lower wall portions include a shoulder portion which protrudes into one of the upper or lower bores. A conventional terminal element is inserted into a front side of the connector where a portion of the terminal element abuttingly engages the internal shoulder portion of the bore in which it is inserted. A shoulder portion positively and effectively prevents the terminal element from being withdrawn by a pulling or tugging force from a rear side of the main body portion. The upper and lower shoulder portions are non-flexible and non-moving and are therefore not susceptible to breakage such as with conventional leaf beam-type latching arms.

2 Claims, 1 Drawing Sheet

ELECTRICAL CONNECTOR

BACKGROUND OF THE INVENTION

1. Technical Field

This invention relates to electrical connectors, and more particularly to an electrical connector having a plurality of non-flexible, non-movable shoulder portions which positively prevent a terminal element inserted therein from being unintentionally pulled out of a rear side of a main body portion of the connector.

2. Discussion

Electrical connectors are used in a wide variety of applications to electrically couple various circuits, wiring harnesses, etc., together. Many such connectors include some form of internal, movable, "beam-type" element which is adapted to abuttingly engage a portion of a terminal element inserted within the connector. Typically the terminal element is inserted from a rear side of the connector body. As it passes adjacent the shoulder portion of the beam-type element the element typically flexes outwardly to allow the terminal element to be inserted completely within the connector, and then latches or otherwise abuttingly engages a portion of the terminal element to help prevent same from being pulled from the rear side of the connector body.

The drawback with the use of beam-type movable latching elements is their propensity to break or flex when a pulling force is exerted on a wire attached to the terminal element being secured by the latching member. Since the beam-type elements are flexible, on occasion they break or may be caused to flex such that the terminal element within the connector may be inadvertently pulled from the connector body. Such instances are highly undesirable, especially in motor vehicle applications where electrical connectors may not always be easily and readily accessible for repair. Such instances where a terminal element is accidentally pulled from the connector body may also necessitate time consuming electrical trouble-shooting in an otherwise complicated wiring system by a qualified technician to isolate the accidentally removed terminal element. Such situations not only represent a serious inconvenience but also may necessitate the entire connector being replaced if some suitable repair cannot be made to a broken beam-type latching element.

Connector designs requiring a flexible, beam-type latching member further are required to be made from material having a high flex modulus. Moreover, the tooling which must be used to make flexible beam-type latching members is very fragile and a generally high maintenance item. Still further, problems are frequently encuntered with filling of material which is to form the flexible member, as well as underfilling and trapped air, all of which can lead to brittleness of the flexible beam-type latching member.

Accordingly, it is a principal object of the present invention to provide an electrical connector which even more securely and effectively holds a terminal element therein in response to pulling forces exerted on the terminal element, which might otherwise cause the terminal element to be accidentally withdrawn from the electrical connector.

It is another object of the present invention to provide an electrical connector which includes a plurality of non-flexible, non-movable shoulder portions for even more securely and effectively securing a terminal element within a bore of a connector such that a pulling force exerted on an electrical conductor coupled to the terminal element, or the terminal element itself, will not cause the terminal element to be pulled from the electrical connector.

It is still another object of the present invention to provide an electrical connector which more positively and effectively secures a terminal element therewithin without any use of traditional leaf beam-type latching members.

SUMMARY OF THE INVENTION

The above and other objects are provided by an electrical connector in accordance with a preferred embodiment of the present invention. The electrical connector generally comprises a main body portion having a front side and a rear side, a plurality of bores formed therein for receiving conventional terminal elements, and a non-flexible, non-removable shoulder portion formed within each one of the bores adapted to abuttingly engage with a portion of a terminal element inserted within the bore, to thereby positively prevent the terminal element from being withdrawn from the rear side of the main body portion.

In the preferred embodiment the main body portion further includes a plurality of rib portions, with each rib portion protruding into an associated one of the bores. The rib portions are each adapted to cause an external terminal member inserted within its associated bore to be positively urged into electrical contact with a terminal element inserted within the associated bore.

In the preferred embodiment a front cover portion is also included which fits over the front side of the main body portion and is lockably secured to the main body portion. The front cover portion includes a plurality of apertures which are longitudinally aligned with the bores in the main body portion, to thereby allow external terminal members to be inserted through the apertures into the bores.

The preferred embodiment of the present invention even more positively and effectively holds terminal members within the bores of the connector such that the terminal members cannot be pulled out of the main body portion from its rear side by some external pulling force. Since the shoulder portions are non-flexible and non-movable, they are not susceptible to breakage as are conventional leaf beam-type latching members.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENT

Figure 1:
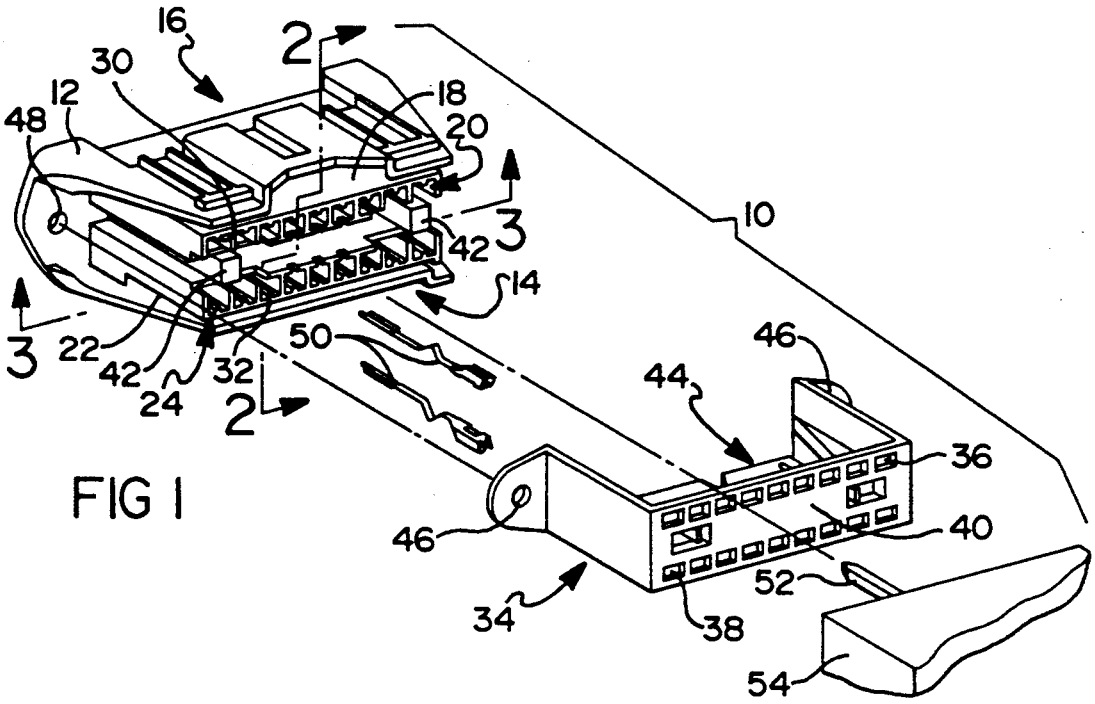
FIG. 1 is an exploded perspective view of an electrical connector in accordance with a preferred embodiment of the present invention.

Referring to FIG. 1, there is shown electrical connector 10 in accordance with a preferred embodiment of the present invention. The electrical connector 10 comprises a main body portion 12 having a front side 14 and a rear side 16, an integrally formed inner upper wall portion 18, an upper plurality of bores 20 formed in an upper row adjacently one another, an integrally formed inner lower wall portion 22, and a plurality of lower bores 24 formed in a lower row adjacently one another.

Figure 2:
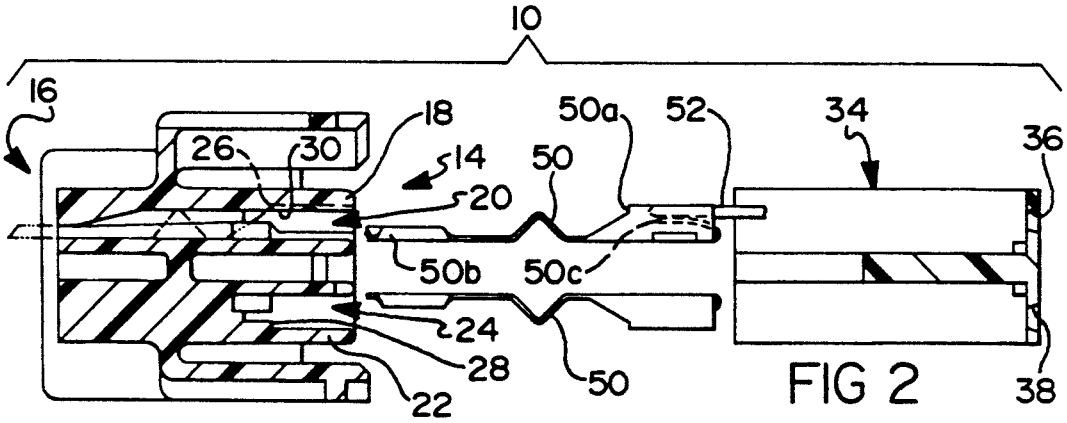
FIG. 2 is a cross sectional side view of the electrical connector of FIG. 1 taken in accordance with section line 2—2.

With reference to FIG. 2, electrical connector 10 advantageously includes a plurality of internal upper shoulder portions 26 (only one being shown via a hidden line in FIG. 2) and a plurality of internal lower shoulder portions 28 (only one of which is shown in FIG. 2). Each upper shoulder portion 26 protrudes into an associated one of the upper bores 20, while each one of the lower shoulder portions 28 protrudes into an associated one of the lower bores 24. The shoulder portions 26 and 28 are each non-flexible and non-movable, and are therefore not susceptible to breakage or inadvertent flexing, which might allow a conventional terminal element inserted therein to be inadvertently withdrawn from the connector 10.

Figure 3:
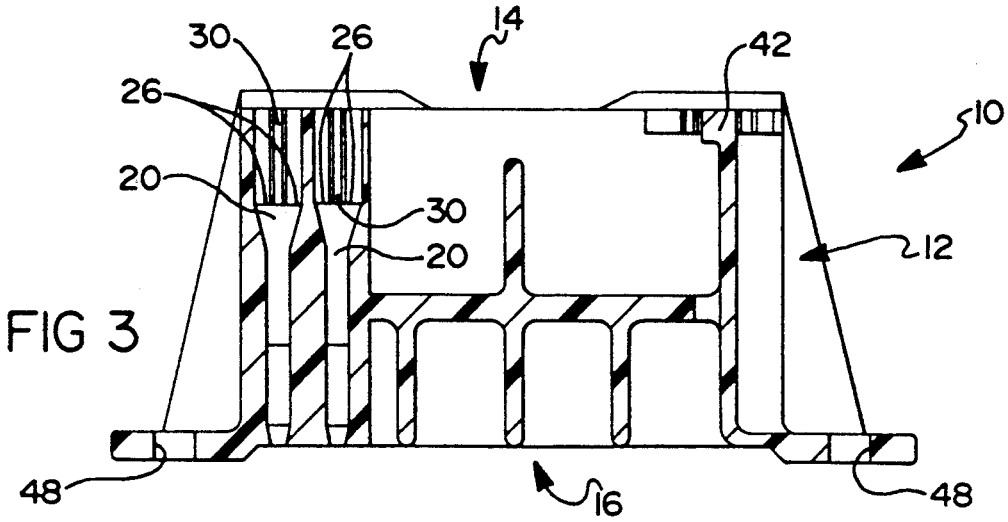
FIG. 3 is a cross sectional view of the electrical connector of FIG. 1 taken in accordance with section line 3—3.

With reference to FIGS. 1 and 2, the inner upper wall portion 18 further includes a plurality of upper rib portions 30 and a plurality of lower rib portions 32. Each one of the upper rib portions 30 protrudes into an associated one of the upper bores 20 while each one of the lower rib portions 32 protrudes into an associated one of the lower bores 22. The lower rib lo portions are also shown in FIG. 3.

In the preferred embodiment the connector 10 further comprises a front cover portion 34. The front cover portion 34 includes a row of upper apertures 36 and a row of lower apertures 38 formed in a face portion 40 thereof. Each of the upper apertures 36 are formed so as to be in longitudinal alignment with an associated one of the upper bores 20. Similarly, each one of the lower apertures 38 are formed so as to be positioned in longitudinal alignment with associated ones of the lower bores 24. The front cover portion 34 is latchably secured to the main body portion 12 via latching posts 42 and conventional latching arm portions (not shown) on an inner side 42 of the front cover portion 34. The front cover portion 34 may further be secured by a threaded screw or other like member (not shown) via apertures 46 in the front cover portion 34 and apertures 48 in the main body portion 12.

With specific reference to FIG. 2, a conventional terminal element 50 is inserted into the front side 14 of the main body portion 12 rather than the rear side 16, as would be done with conventional connectors. The terminal element 50 has an edge portion **50*a* which when fully inserted into the main body portion 12 abuttingly engages the upper shoulder portion 26 protruding within the upper bore 20 in which the terminal element 50 is inserted. The upper shoulder portion 26 positively and effectively prevents the terminal element 50 from being pulled or otherwise withdrawn from the main body portion 12 by a pulling force exerted on a rear portion 50*b* of the terminal element 50. Since the upper shoulder portion 26 is integrally formed with the inner upper wall portion 18, and is therefore non-flexible and non-moving, there is no chance that the upper shoulder portion 26 might be caused to break away from the main body portion 12 or otherwise flex in such a manner as to permit the terminal element 50 to be withdrawn from the rear side 16 of the connector 10**.

With further reference to FIG. 1, the upper rib portions 30 and the lower rib portions 32 each cause a conventional male terminal member 52 of an external conventional connector member 54 to be urged into positive electrical contact with a flexible member **50*c* of the conventional terminal element 50. When the male terminal member 52 is inserted into the terminal element 50, while the terminal element 50 is residing within one of the upper bores 20, each rib portion 30 forces the terminal member 52 into constant abutting contact with the flexible member 50*c* of its associated terminal element 50. The lower rib portions 32** function in an identical manner.

The connector 10 of the present invention, since it does not require a flexible beam-type latching member, allows simpler tooling to be used to form the connector 10, and further allows higher strength material and higher filler to be used. The connector 10 may be formed through conventional molding techniques from plastic or other materials having a relatively high strength.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. An electrical connector comprising:

a main body portion having a front side, a rear side, an inner upper wall portion and an inner lower wall portion;

a first plurality of bores formed in part from said inner upper wall portion;

a second plurality of bores formed in part from said inner lower wall portion;

said inner upper wall portion including a plurality of non-flexible, non-movable, internal upper shoulder portions, with each one of said internal upper shoulder portions protruding into an associated one of said bores of said upper row of bores;

said inner lower wall portion including a plurality of non-flexible, non-movable internal lower shoulder portions, each one of said lower shoulder portions protruding into an associated one of said bores of said lower row of bores;

each bore of said upper and lower rows of bores being adapted to slidably receive therein a terminal element inserted therein from said front side of said main body portion;

each one of said internal shoulder portions being adapted to engage a portion of an associated one of said terminal elements inserted within its associated bore to thereby prevent said terminal element from being pulled from said rear side of main body portion out of said main body portion wherein said inner upper wall portion includes a plurality of upper rib portions, with each one of said upper rib portions protruding into an associated one of said bores;

wherein said inner lower wall portion includes a plurality of lower rib portions, with each one of said lower rib portions protruding into an associated one of said bores of said lower row of bores;

each one of said upper and lower rib portions being operable to help facilitate electrical connection between a terminal element inserted within each one of said bores and a terminal member protruding into an associated one of said bores by forcing said terminal member into electrical contact with said terminal element inserted within said associated one of said bores.

2. An electrical connector comprising:

a main body portion having a front side, a rear side, an integrally formed inner upper wall portion, and an integrally formed inner lower wall portion;

said inner upper wall portion partially defining a plurality of upper bores formed in an upper row;

said inner lower wall portion helping to define a plurality of lower bores formed in a lower row;

said inner upper wall portion including a plurality of inflexible, non-movable internal shoulder portions integrally formed therewith, each protruding into an associated one of said upper bores;

said inner lower wall portion including a plurality of inflexible, unmovable internal lower shoulder portions integrally formed therewith, each protruding into an associated one of said lower bores of said lower row of bores;

a plurality of terminal elements inserted within said upper and lower bores from said front side of said main body portion, said upper and lower internal shoulder portions operating to abuttingly engage a portion of each of said terminal elements to prevent each of said terminal elements from being withdrawn from said main body portion out of said rear side of said main body portion;

a front cover portion adapted to be secured over said front side of said main body portion to maintain said terminal elements within said upper and lower bores, said front cover portion including a plurality of apertures forming an upper row and a lower row, each one of said apertures being positioned in longitudinal alignment with an associated one of said bores such that a terminal member inserted through any one of said apertures engages an associated one of said terminal elements housed within one of said bores wherein said inner upper wall portion includes a plurality of upper rib portions, with each one of said upper rib portions protruding into an associated one of said bores;

wherein said inner lower wall portion includes a plurality of lower rib portions, each one of said lower rib portions protruding into an associated one of said bores; and each one of said upper and lower rib portions operating to urge a terminal member into engagement with a terminal element inserted within its associated bore, to thereby ensure electrical contact between said terminal member and said terminal element.

* * * * *